United States Patent [19]

Noerager et al.

[11] 4,272,059

[45] Jun. 9, 1981

[54] RISER TENSIONER SYSTEM

[75] Inventors: Jere A. Noerager; Daniel G. Taft; John M. Bednar, all of Houston, Tex.

[73] Assignee: Exxon Production Research Company, Houston, Tex.

[21] Appl. No.: 40,241

[22] Filed: May 21, 1979

Related U.S. Application Data

[63] Continuation-in-part of Ser. No. 916,404, Jun. 16, 1978, abandoned.

[51] Int. Cl.[3] ..... E21B 7/12

[52] U.S. Cl. ..... 254/392; 166/355

[58] Field of Search ..... 254/228, 242, 264, 270–273, 254/277, 280–281, 284–285, 291, 315, 326, 335–336, 361, 386, 392, 398, 900; 175/5, 7, 27; 166/355; 114/214, 215, 264

[56] References Cited

U.S. PATENT DOCUMENTS

| | | | |
|---|---|---|---|
| 3,601,187 | 8/1971 | Tidwell | 166/355 |
| 3,605,415 | 9/1971 | Mohlman | 61/46 |
| 3,653,635 | 4/1972 | Bates et al. | 254/392 |
| 3,721,293 | 3/1973 | Ahlstone et al. | 254/270 X |
| 3,760,875 | 9/1973 | Busking | 166/355 |
| 3,834,672 | 9/1974 | Hawley et al. | 254/392 |
| 3,891,038 | 6/1975 | Delestrade et al. | 175/7 |
| 3,897,045 | 7/1975 | Butler | 254/392 |
| 3,976,148 | 8/1976 | Maus | 175/7 |

FOREIGN PATENT DOCUMENTS 1485657 9/1977 United Kingdom .

*Primary Examiner*—John M. Jillions
*Attorney, Agent, or Firm*—Robert B. Martin

[57] ABSTRACT

A tensioner system is disclosed for applying tension to a riser pipe extending between a floating vessel and the sea bottom. The tensioner comprises a guide means fixed onto the floating vessel for restraining guide members from substantial lateral movement relative to the vessel while permitting relative vertical motion of the guide members, means on the vessel for applying vertical tension to the guide members and suitable means for connecting the guide members to the riser such that the vertical tension applied to the guide members is substantially the same as the vertical tension applied to the riser.

20 Claims, 7 Drawing Figures

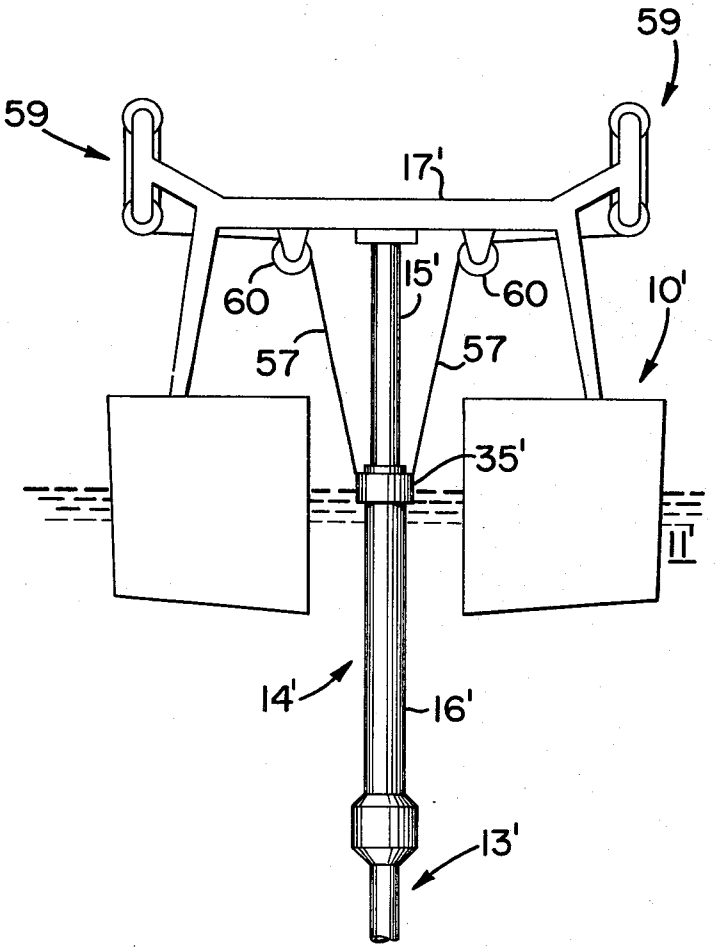
FIG. 5 - PRIOR ART
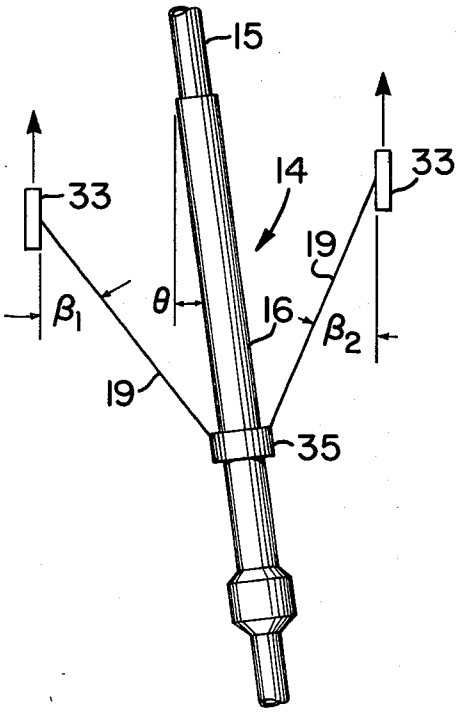
FIG. 4
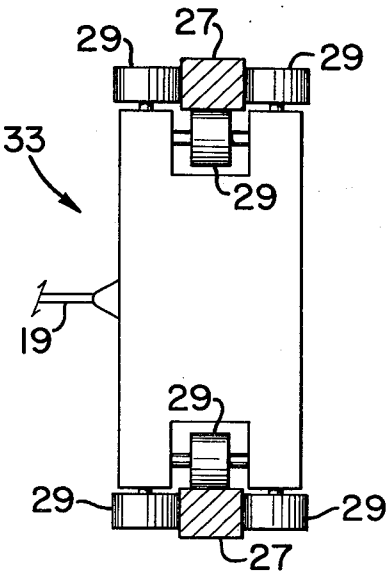
FIG. 3

RISER TENSIONER SYSTEM

BACKGROUND OF THE INVENTION

1. Related Applications

This application is a continuation-in-part of U.S. application Ser. No. 916,404 filed June 16, 1978, now abandoned.

2. Field of the Invention

The present invention pertains to an apparatus for maintaining tension on a riser pipe extending between a floating vessel and a subsea wellhead.

3. Description of the Prior Art

Offshore drilling operations are often facilitated by the use of a riser pipe extending between a floating vessel and a wellhead on the ocean floor. A riser pipe operating on the floating vessel in water depths greater than about 200 feet (60.96 meters) can buckle under the influence of its own weight and the weight of drilling fluid contained within the riser if it is not partially or completely supported. The support must come from axial tension applied to the top of the riser and/or buoyancy along the length of the riser. Tension controls the stress level in the riser pipe and affects the riser straightness. As water depth increases, the axial tension required to provide proper support also increases.

Marine risers have been tensioned in various manners including the use of counterweights and pneumatic spring systems. The counterweight was the first technique utilized to apply tension to the top of the marine riser. The weight was hung from a wire rope which was reeved up over wire rope sheaves and down to the top of the riser pipe. The tension was equal to the counterweight and therefore was practicable only for shallow water that required low tension.

The pneumatic spring systems replaced the counterweight systems as deeper water drilling evolved. The pneumatic tensioning devices stored energy in the form of compressed air to apply tension to the top of the riser through wire ropes. Generally the pneumatic tensioning devices involved the use of cylinders from which a piston rod was extended, the piston rod had a sheave engaged by the wire rope to be tensioned. The fluid within the hydraulic cylinder was thereby compressed into an accumulator. The cylinder and the accumulator were normally supported by support structures on the floating vessel.

Tensioner systems in use today act as oil-damped pneumatic springs. A large air supply keeps a nearly constant pressure above the oil in an air-oil accumulator cylinder. The oil then provides pressure to the face of the piston. As the vessel heaves, the piston moves up and down against a relatively constant force and the tension lines maintain a relatively constant pull. A series of sheaves are provided on the tensioner and the reeving typically used will give a piston stroke of about one-fourth of the vessel heave.

The tensioner lines are normally run over fixed sheaves supported from the drill floor substructure and attached to a tension ring near the top of the outer barrel of the riser slip joint. An even number of tensioners are generally employed and the lines are equally loaded with opposing pairs on opposite sides of the outer barrel. The angles between the tensioner lines and the riser are minimized by locating the turndown sheaves as close to the axis of the riser as possible so that the maximum vertical tension can be supplied to the riser. This configuration also minimizes variation in tension on the riser when excessive vessel heave, pitch, and roll are experienced. However, some tension variation is unavoidable with this system.

Tensioner systems proposed in the past are subject to several disadvantages, one disadvantage being that the tensioning lines often fail under high tension. Failure is generally attributed to fatigue failure caused by continuously bending the wire cable back and forth over the sheaves. Another problem is that conventional tensioning systems do not have the capacity to provide the tension necessary for deepwater drilling. Conventional individual tensioners usually have a capacity of no more than about 80,000 lbs (355,856 Newtons); therefore a large number of tensioners are often required for drilling in water over 3000 feet (914 meters) deep. Still another problem associated with conventional tensioner systems is that high tensions can adversely affect vessel stability.

An improved riser tensioner system is needed which provides high-capacity tension and prolonged fatigue life and does not adversely affect vessel stability.

SUMMARY OF THE INVENTION

The present invention is directed toward a riser tensioner system which alleviates the difficulties outlined above.

Broadly, the tensioner system of the present invention includes at least two tensioning devices positioned adjacent an aperture formed in the floating vessel which is commonly referred to as a moonpool. Each tensioning device includes a guide means such as tracks secured to the vessel, as for example to the side wall of the moonpool and positioned in alignment with the moonpool. The tensioning device further includes guide members movable along the tracks, and means such as a hydraulic ram for applying a vertical force on the guide members. The guide members are connected to the riser by fixed-length, tension-carrying means such that vertical forces applied to the guide members produce substantially equal vertical forces on the riser. Each guide member is capable of independent movement along the length of the track.

In one embodiment of this invention, a riser tensioner system is described which comprises a hydraulic cylinder in which fluid under pressure maintains an upward force on a ram or piston rod. An idler pulley or sheave is mounted on the free end of this rod. Pressure is maintained essentially constant in the hydraulic cylinder by an air/oil accumulator and a bank of high pressure air vessels. A leaf chain is anchored at or near the top of the cylinder and passes over the pulley to a guide member that is constrained to travel between a pair of guide rails. A wire cable connects the guide member and the outer barrel of the riser slip joint.

The high capacity riser tensioner system of this invention is a significant improvement over tensioner systems previously proposed. In addition to improved vessel stability, the tensioner system of this invention is more efficient and has higher reliability than tensioners proposed in the past.

BRIEF DESCRIPTION OF THE DRAWINGS

FIG. 3 is a plan view of guide member 33 shown in FIG. 2.

FIG. 4 is a schematic view illustrating the relationship of the tensioning lines of the tensioner system shown in FIG. 1 when the riser is in a non-vertical position.

FIG. 5 is an elevation view of a prior art tensioner system.

DESCRIPTION OF THE PREFERRED EMBODIMENTS

Figure 1:
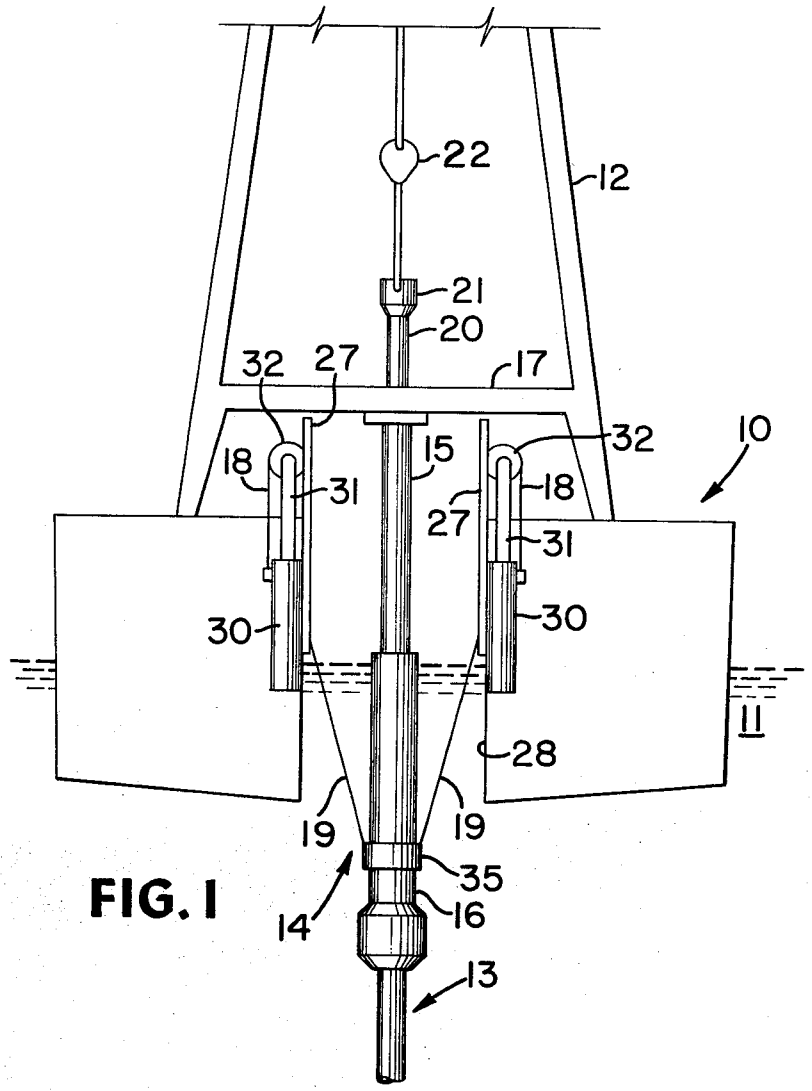
FIG. 1 is a schematic elevation view, partly in section, of a drilling vessel floating on a body of water and provided with apparatus embodying the present invention.

Referring to FIG. 1, there is shown drilling vessel 10 floating on a body of water 11 and engaged in drilling of a subsea well (not shown). The vessel has mounted on its deck a substructure 17 which supports a derrick 12 which includes a drawworks (not shown) and other usual apparatus for conducting drilling operations. The vessel has a walled, round hole 28 (the moonpool) in its hull through which the drilling assemblies pass while the well is being drilled. Extending between the vessel and the wellbore in the seabed is a marine riser generally indicated at 13 which at its lower end is connected to a wellhead through the usual blowout preventer apparatus (not shown) and which at its upper end is connected to the substructure 17. The marine riser 13 includes a slip joint 14 near its upper end. The slip joint 14 includes an upper cylindrical portion 15, generally referred to as the "inner barrel", which is mounted from and is movable with the vessel 10 and a lower cylindrical portion 16, generally referred to as the "outer barrel", which is attached to the riser. The inner barrel telescopes into and out of the outer barrel as the vessel moves relative to the wellbore.

A drill string generally indicated at 20 is supported from a swivel 21 within the derrick. The swivel 21 is suspended from a traveling block 22 which in turn is connected by cables to the crown block (not shown) at the top of the derrick. The drill string extends downwardly through the marine riser 13 into the wellbore.

Figure 2:
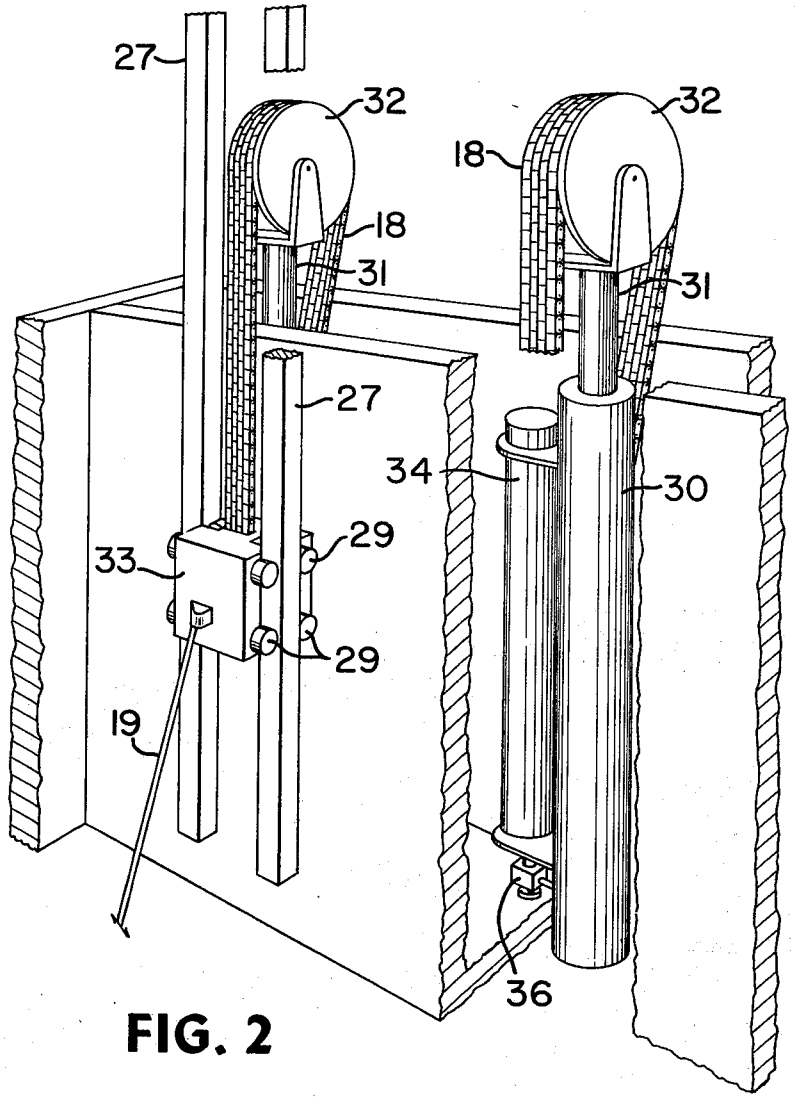
FIG. 2 is an enlarged perspective view, with portions cut away, of one embodiment of the tensioner system of this invention.

The drilling riser 13 is supported in tension at its upper end to prevent the riser from buckling under the influence of its own weight. Referring to FIGS. 1 and 2, tension is applied to the riser by hydraulic cylinders 30 which contain hydraulic fluid under pressure to maintain an upward force on rams 31. Pressure is maintained essentially constant in the hydraulic cylinders 30 by air/oil accumulators 34 and air banks (not shown). Pulleys or sheaves 32 are mounted on the free ends of the rams 31. Tension-carrying lines 18 such as wire cables or chains are anchored in a suitable manner to a stationary point near the upper end of the cylinders 30 and pass over the sheaves 32 to guide or skate members 33 which are restrained to move vertically between guide rails or tracks 27. Fixed-length tension-carrying links 19, such as cables, connect the guide members 33 and a tension ring 35 which is connected to the outer barrel 16 of the riser slip joint. A flow control valve 36 located between the air/oil accumulator 34 and the cylinder 30 limits the ram speed in the event the mechanical link to the riser fails. Referring to FIGS. 2 and 3, guide members 33 are restrained in guide rails 27 by rollers 29. The rollers 29 rotate as the guide members 33 travel up and down the guide rails 27 to reduce friction. The guide rails 27 are attached to the walls of the moon pool 28 by welding or other suitable means.

The hydraulic cylinders 30 used in this invention to maintain an upward force on tension-carrying lines 18 may be selected from a suitable ram or piston-type hydraulic cylinder. Selection of suitable hydraulic cylinders will depend upon the force and stroke requirements. The ram-type hydraulic tensioners illustrated in FIGS. 1 and 2 should have a tension capacity ranging from about 80,000 pounds (355,856 Newtons) to 300,000 pounds (1,334,460 Newtons) or more with a stroke ranging from 10 to 50 feet (3 to 15 meters).

It should be understood that although FIG. 1 shows only two tensioner units, the tensioner system of this invention may comprise several units. Generally an even number of tensioner units are employed and the tension carrying lines are equally loaded with the opposing pairs connected on opposite sides of the riser. Preferably, the units are paired such that when one tensioner unit is inactive, the opposing unit is inactive.

Preferably, tension-carrying line 18 is a corrosion resistant leaf chain. A leaf chain is more desirable than a wire rope because the chain offers increased service life, improved flexibility, and permits use of a smaller diameter sheave. A suitable chain may be expected to have a service life of several years at normal operating loads of between 30 and 70 percent of the full rated load of the tensioner. In contrast, wire ropes subjected to the same operating conditions would need to be changed or line-slipped about every month to prevent failure. Minimizing wire rope fatigue due to bending requires that the sheaves have a diameter of at least 30 times that of the wire rope. A chain, on the other hand, is capable of handling the same tension with a sheave diameter of about one-half to three-quarters of that needed for a wire rope.

Any leaf chain having suitable strength and corrosion resistance may be used in the practice of this invention. Examples of suitable materials for chain include nickel-chrome alloy stainless steel for the chain links and pins and a high bearing strength teflon fabric for the bearings. Specific examples of suitable materials for chain links are alloys such as Nitronic 50 and 17-4PH stainless steels manufactured by Armco Steel Corporation and Hastelloy C-276 and MP35N manufactured by Cabot Corporation. A suitable pin comprises an alloy such as Aquamet 22 and is also available from Armco Steel Corporation. The pin is centerless ground and polished with a high degree of straightness for use as shafting material in marine environments.

Fixed-length, tension-carrying links 19 may comprise any suitable means for transferring force from the guide members to the riser. The links may be wire cables, chains or substantially rigid rods flexibly connected to the guide members 33 and riser 13.

The guide rails should have sufficient length to permit coupling member 33 to travel more than the heave of the vessel. For drill ships, it is preferred that the guide rails extend from near the vessel's keel to the drilling floor substructure. Although not shown in FIGS. 1 and 2, the end of the guide rails extending above the lower deck will generally need additional structural support to withstand lateral forces on the coupling members caused by angular motion of the riser.

The coupling member 33 is required in this invention to provide uniform loading of the tension line 18 as the riser moves around in the moonpool. Preferably the mean location of the coupling member is at or near the mid-point of the guide rails. On many vessels this location corresponds to the mean water line of the vessel. At this location, the point of tensioner load application on the vessel is considerably below the drill floor.

An important advantage of the tensioner system of this invention over conventional tensioner systems is that the vertical component of tension supplied to the riser is constant regardless of inclinations of the slip joint relative to the vessel. Referring to FIG. 4, the vertical tension on the riser is independent of both the angle $\theta$ between the slip joint and vertical (hereinafter referred to as "slip joint angle") and the angles $\beta_1$ and $\beta_2$ between the tension links 19 connecting the coupling members to the riser and vertical (hereinafter referred to as "fleet angles"). The tension in tension link 19 is therefore greater than the tension in the tension line 18. Because the tensioner force is applied vertically at the guide member, conservation of force in the vertical direction requires that the vertical force applied to the riser is the same as the upward force applied to the guide members 33, assuming no frictional losses.

Another important advantage of the present invention over conventional tensioner systems is that the present system alleviates problems associated with vessel stability because the weight of the tensioners and the point of application of the tensioner forces on the vessel are relatively close to the vessel keel.

The tensioner system of this invention effectively resists angular misalignment between the drill string and the top of the riser. The length of the tension links 19 between the guide members 33 and the riser is constant. Therefore, as the slip joint angle $\theta$ increases as a result of hydrodynamic loading on the riser, such as that due to sea currents, the fleet angle $\beta_1$ on the up-current side of the riser increases and the fleet angle $\beta_2$ on the down-current side of the riser decreases. The horizontal force on the top of the riser therefore increases on the up-current side of the riser and decreases on the down-current side to resist the increased hydrodynamic loading. The resulting unbalanced horizontal force on the riser minimizes angular motion of the riser. This resistance to lateral motion minimizes wear in the riser and alleviates possible damage to the riser by minimizing the chances of the slip joint hitting the side of the moonpool.

The tension ring 34 shown in FIG. 1 should preferably be attached to the riser so that when the slip joint is in the vertical position the static fleet angles (fleet angles with the riser vertical when the slip joint angle is zero) range between about 5° and about 15°. When the fleet angles are above about 15°, the bending stresses on the slip joint are generally unacceptably high and when the fleet angles are below about 5°, angular motion of the slip joint is unacceptably high. Because the mean position of both the guide members 33 and top of the outer barrel are at or near the water surface in the moonpool, maintaining acceptable fleet angles for a typical riser system generally requires that the tension ring 35 be located below the mid-point of the outer barrel. As the riser attachment point is lowered to a location near the bottom of the outer barrel, bending stresses are significantly reduced while angular motion of the slip joint is increased.

To demonstrate the effectiveness of this invention for resisting angular motion of a riser slip joint and at the same time minimizing bending stresses in the slip joint, a conventional tensioner system was mathematically compared to three tensioner systems of this invention. The conventional tensioner system illustrated schematically in FIG. 5 was compared to tensioner systems similar to the system illustrated in FIG. 1 with each system having a different fleet angle. For the sake of clarity, the conventional tensioner system will be referred to herein as Tensioner A and the three tensioner systems of this invention will be referred to herein as Tensioners B, C and D.

Tensioner A will now be described with reference to FIG. 5. Shown in FIG. 5 is a vessel 10' floating on a body of water 11'. The vessel has mounted on its deck a substructure 17' which supports a derrick (not shown) and other usual apparatus for conducting drilling operations. Extending between the vessel 10' and the wellhead (not shown) is a riser shown generally by numeral 13'. The riser includes a slip joint 14' near its upper end with inner barrel 15' and outer barrel 16'. Upward tension forces are supplied to tension ring 35' at the top of the outer barrel 16' by tension-carrying cables 57 which extend around independent sheaves 60 fixed to the vessel's substructure 17' and then extend to tensioning means shown generally by the numerals 59. As the vessel rises and falls with respect to the riser, the tensioner means 59 take up and let out cables 57 to accommodate the vessel movement. For purposes of this comparison, the horizontal distance between the outside edge of the sheaves 60 and the attachment point on tension ring 35' was 8.5 feet and the slip joint 14' and riser 13' of FIG. 5 are the same as the slip joint 14 and riser 13 of FIG. 1.

Tensioner systems B, C, and D were similar to the tensioner configuration illustrated in FIGS. 1-3 with static fleet angles of 15°, 8°, and 7.08° respectively.

All the calculations used in this comparison were performed using a hypothetical vessel having a 22-foot (6.7 meters) diameter moonpool, a riser slip joint of conventional design similar to the 18⅝ inch (0.473 meters) X 50-foot (15.24 meters) stroke type 'WJ' slip joint manufactured by Vetco Offshore, Inc. and a hydropneumatic tensioning system which maintained one million pounds (4,448,200 Newtons) of tension in cables 57 of Tensioner A and lines 18 of Tensioners B, C, and D.

The comparison was carried out by first determining the total horizontal forces at the top of the riser that would be needed to obtain a slip joint angle of 4° on Tensioner A at slip joint strokes of 10, 25, and 40 feet (3.084, 7.62 and 12.19 meters). (A slip joint stroke of zero corresponds to the inner barrel fully collapsed within the outer barrel.) The total horizontal force required to keep the slip joint angle of Tensioner A at 4° was calculated to be 68,800, 71,100, 71,350 pounds (306,036, 316,267, and 317,379 Newtons) at slip joint strokes of 10, 25, and 40 feet (3.048, 7.62 and 12.19 meters), respectively. The bending stress and slip joint angles for Tensioners B, C and D were then calculated under conditions where the same horizontal forces applied to Tensioner A were applied to Tensioners B, C and D. The results of these calculations are set forth below in Table I.

| Tensioner System | Fleet Angle (deg) | Slip Joint Angle (deg) | Maximum Stress in Inner Barrel (psi) | Slip Joint Stroke (ft) | Length of Tension Link (ft) | Total Horizontal Force on Riser (lb) |
|---|---|---|---|---|---|---|
| | 14.1 | 4.00 | 7.243 | 10 | 18.5 | 68.800 |
| A | 7.7 | 4.00 | 8,759 | 25 | 33.5 | 71,100 |
| | 5.3 | 4.00 | 8,273 | 40 | 48.5 | 71,350 |
| | | 2.87 | 17,611 | 10 | 28.98 | 68,800 |
| B | 15 | 2.28 | 42,991 | 25 | 28.98 | 71,100 |
| | | 1.82 | 64,404 | 40 | 28.98 | 71,350 |
| | | 3.08 | 2,140 | 10 | 53.91 | 68,800 |
| C | 8 | 2.63 | 5,759 | 25 | 53.91 | 71,100 |
| | | 2.24 | 9,300 | 40 | 53.91 | 71,350 |
| | | 3.22 | 693 | 10 | 60.85 | 68,800 |
| D | 7.08 | 2.70 | 1,900 | 25 | 60.85 | 71,100 |
| | | 2.33 | 3,113 | 40 | 60.85 | 71,350 |

As shown in Table 1, the calculated bending stresses for tensioner systems C and D were considerably less than the bending stress for the conventional system and the slip joint angles for Tensioners B, C and D were less than 4°.

Figure 6:
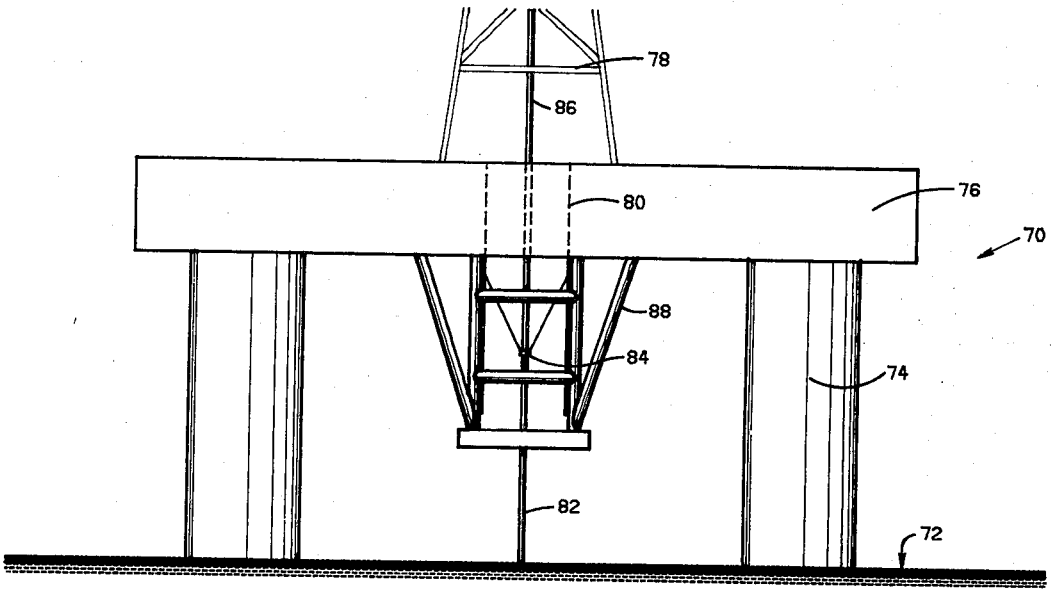
FIG. 6 is a schematic view, in section, of a semisubmersible drilling vessel floating on a body of water and provided with apparatus embodying the present invention.
Figure 7:
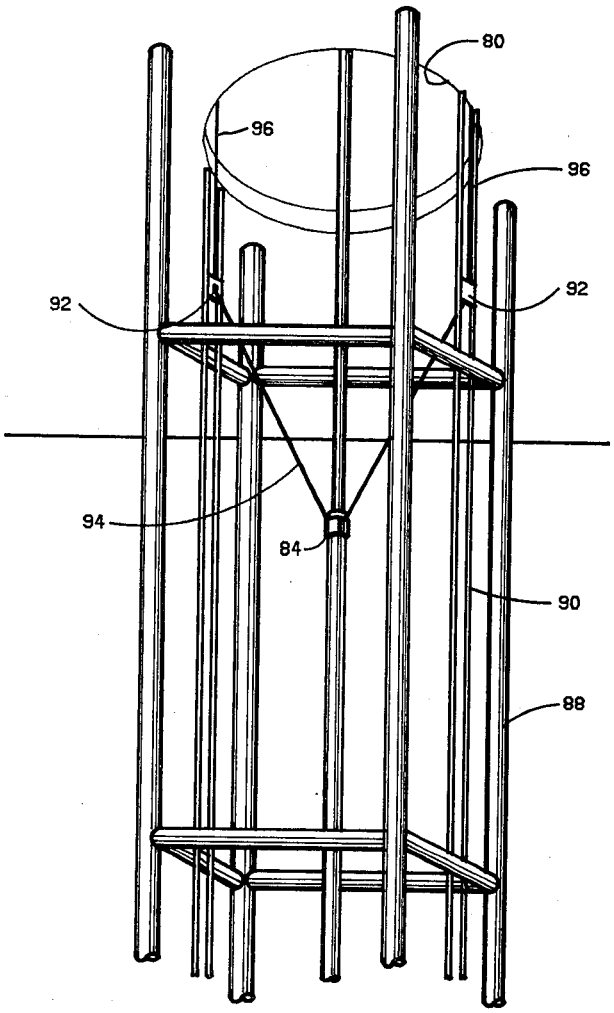
FIG. 7 is a perspective view, partly in section, of the apparatus embodying the present invention.

Referring to FIGS. 6 and 7 there is shown an alternative embodiment of the tensioner system of the present invention. In FIG. 6, there is shown a semisubmersible drilling vessel 70 floating on a body of water 72 and engaged in drilling a subsea well (not shown). The vessel comprises generally caissons 74 which are supported by underwater buoyant pontoons (not shown), deck area 76 and drilling derrick 78. The drilling derrick is provided with all the usual apparatus for conducting drilling operation. The vessel has a moonpool 80 formed in the deck 76. The vessel is further provided with a marine riser 82 which extends between the vessel and the wellhead at the sea bed. The riser 82 is provided with a slip joint 84 near its upper end. The drill string 86 is supported by the derrick 78 and extends downwardly through the marine riser 82 into the well bore. The vessel is further provided with support structure 88 which supports the tensioner system of the present invention.

Referring to FIG. 7, the tensioner system of the present invention generally comprises guide rails or tracks 90, guide member 92, fixed-length, tension-carrying means 94 and tension carrying lines 96. The fixed-length, tension-carrying means 94 extends from the slip joint 84 of the riser to the guide member 92. Each guide member is capable of independent movement along the length of guide rails 90 with respect to the other guide member. The tension carrying lines 96 extend between the guide members 92 and hydraulic rams or the like (not shown) which are positioned in the deck area of the vessel or on the drilling platform. The tension-carrying lines preferably extend over the sheaves of vertically positioned hydraulic rams and are anchored in a suitable manner to the vessel. The guide rails or tracks 90 are supported by support frame 88. Support frame 88 is positioned below the deck area 76 of the vessel and is connected to the bottom of the deck area of the vessel. In the preferred embodiment, the guide rails 90 extend into the moonpool 80 of the vessel and may be attached to the wall of the moonpool. However, the guide rails may be positioned below the moonpool in alignment with the moonpool.

In operation, the hydraulic rams maintain an upward tension on tension-carrying lines 96. The tension is transmitted through the guide members 92 and the fixed-length, tension-carrying means 94 to the riser.

The tensioner system of this invention may also be used on floating production systems that use drilling riser technology in a production riser application. Production systems sometimes use an anchored semi-submersible vessel as a production platform and a large, negatively-buoyant production riser tensioned from the vessel by conventional means. In contrast to a typical floating drilling operation in which tensioners are in service perhaps one-half of the time, tensioners for production riser systems will have to remain in service for the life of the field. The low maintenance requirements of the high capacity tensioner of this invention offer a significant advantage over conventional tensioners.

The principle of the invention and the best mode in which it is contemplated to apply that principle have been described. It is to be understood that the foregoing is illustrative only and that other means and techniques can be employed without departing from the true scope of the invention as defined in the following claims.

We claim:

1. A tensioner system for a riser pipe extending between an aperture formed in a floating vessel and the bottom of the sea comprising
   - a plurality of guide means fixed onto the floating vessel and positioned in alignment with said aperture;
   - a plurality of guide members being restrained by said guide means from substantial lateral motion relative to the vessel, said guide means permitting independent relative vertical motion of each of the guide members;
   - means on said vessel for applying vertical tension to said guide members; and
   - a plurality of fixed-length, tension-carrying means extending from said guide members to said riser pipe for transmitting tension from said guide members to said riser pipe.

2. The tensioner system as defined in claim 1 wherein said guide means comprise a plurality of guide rails fixed onto the wall of said aperture in said floating vessel.

3. The tensioner system as defined in claim 2 wherein the length of the guide rails is greater than the heave of the vessel.

4. The tensioner system as defined in claim 1 wherein the means for applying vertical tension comprises a hydraulic tensioning device.

5. The tensioner system as defined in claim 4 wherein the tension capacity of the hydraulic tensioning device ranges from 80,000 to 300,000 pounds.

6. The tensioner system as defined in claim 1 wherein the tension-carrying means comprises wire cables.

7. The tensioner system as defined in claim 1 wherein the tension-carrying means comprises substantially rigid rods that are flexibly connected to the guide members and the riser.

8. The tensioner system as defined in claim 6 wherein the tension-carrying means is connected to the riser at an angle between 5 and 15 degrees.

9. The tensioner system as defined in claim 1 wherein said guide means comprise a plurality of guide rails attached to a support structure, said structure being fixed onto the floating vessel.

10. A tensioner system for a riser pipe extending between an aperture formed in a floating vessel and the bottom of the sea comprising a plurality of first tension-carrying means for maintaining tension on a plurality of guide members, each of said first means tensioned at one end by a tensioner means and connected at the other end to a guide member, each of said guide members being constrained by a plurality of guide means attached to the vessel and positioned in alignment with said aperture, said guide members capable of independent movement in a substantially vertical direction with respect to the vessel and a plurality of fixed-length second tension-carrying means for interconnecting said guide members and the riser to maintain tension on said riser.

11. The tensioner system as defined in claim 10 wherein said tensioner means is a hydraulic tensioning device.

12. The tensioner system as defined in claim 10 wherein the first tension-carrying means comprises a wire cable.

13. The tensioner system as defined in claim 10 wherein the first tension-carrying means comprises a leaf chain.

14. The tensioner as defined in claim 10 wherein the angle between the second tension-carrying means and the riser is from 5 to 15 degrees.

15. A tensioner system for a floating vessel having an aperture therethrough and a riser pipe extending from the bottom of the sea to the vessel and through said aperture comprising:

a plurality of guide tracks fixed onto the floating vessel in the aperture for restraining guide members from substantial lateral motion relative to the vessel and for permitting independent relative vertical motion of the guide members along the length of the guide tracks;

tension means attached to the vessel for applying vertical tension to said guide members;

a plurality of fixed length cables connecting said guide members to said riser pipe for applying vertical tension on said riser pipe.

16. A tensioner system for a riser pipe extending between an aperture formed in a floating vessel and a subsea wellhead comprising:

a plurality of guide means fixed to the floating vessel and positioned in alignment with said aperture;

a plurality of guide members restrained by said guide means, said guide means restraining said guide members against substantial lateral movement with respect to the vessel while permitting independent movement in a substantially vertical direction with respect to the vessel;

tension means mounted on the vessel;

a plurality of first tension-carrying means tensioned at one end by said tension means and connected to said guide members at the other end for maintaining upward tension on said guide members; and a plurality of fixed-length second tension-carrying means for interconnecting said riser pipe and said guide members and maintaining tension on said riser pipe.

17. The tensioner system as defined in claim 16 wherein the tension in said second tension-carrying means is greater than the tension in said first tension-carrying lines.

18. A tensioner system for a riser pipe extending from an aperture formed in a floating vessel to a subsea well comprising tension means mounted on the vessel;

a plurality of guide means mounted to the aperture formed in the vessel;

a plurality of guide members connected to the guide means in a manner which restricts the guide members against substantial lateral movement with respect to the vessel while enabling independent movement in a substantially vertical direction with respect to the vessel;

a plurality of first tension-carrying lines, each having one end connected to a guide member for transferring tension from the tension means to the guide member;

a plurality of fixed-length second tension-carrying lines, each having one end connected to a guide member and the other end connected to the riser pipe for applying tension thereto.

19. A system for maintaining tension on a riser pipe extending from the bottom of the sea to an opening formed in a floating vessel, said system comprising a pair of tensioning devices positioned adjacent to said opening and on opposite sides of said riser, each of said devices including:

(a) a substantially vertical cylinder secured to said vessel;

(b) a ram extendable upwardly from said cylinder;

(c) a pulley mounted on the upper end of said ram;

(d) a track secured to the side wall of said opening and extending adjacent and parallel to said cylinder;

(e) a guide member capable of independent movement along said track;

(f) a chain extending over said pulley and having its opposite ends secured to said vessel and said guide member; and (g) a fixed length means for interconnecting said guide member and said riser such that upward movement of said guide member along said track imparts tension on said riser.

20. A system for maintaining tension on a riser pipe extending from the bottom of the sea to an opening formed in a floating vessel, said system comprising a pair of tensioning devices positioned adjacent said opening and on opposite sides of said riser, each of said devices including:

(a) a substantially vertical track secured to the side wall of said opening;

(b) a guide member capable of independent movement along said track;

(c) means for imparting a force on said guide member in the direction of said track; and (d) a fixed length means for interconnecting said guide member and said riser such that upward force applied to said guide member imparts a substantially equal upward force on said riser.

* * * * *